US010590777B2

(12) United States Patent
Brittingham

(10) Patent No.: US 10,590,777 B2
(45) Date of Patent: Mar. 17, 2020

(54) TURBOMACHINE ROTOR BLADE

(71) Applicant: General Electric Company, Schenectady, NY (US)

(72) Inventor: Robert Alan Brittingham, Greer, SC (US)

(73) Assignee: General Electric Company, Schenectady, NY (US)

( * ) Notice: Subject to any disclaimer, the term of this patent is extended or adjusted under 35 U.S.C. 154(b) by 132 days.

(21) Appl. No.: 15/638,571

(22) Filed: Jun. 30, 2017

(65) Prior Publication Data

US 2019/0003317 A1 Jan. 3, 2019

(51) Int. Cl.

| | |
|---|---|
| ***F01D 5/18*** | (2006.01) |
| ***F01D 5/14*** | (2006.01) |
| ***F01D 5/20*** | (2006.01) |
| *F01D 5/22* | (2006.01) |

(52) U.S. Cl.

CPC ..... *F01D 5/187* (2013.01); *F01D 5/147* (2013.01); *F01D 5/20* (2013.01); *F01D 5/18* (2013.01); *F01D 5/225* (2013.01); *F05D 2240/24* (2013.01); *F05D 2240/301* (2013.01); *F05D 2240/307* (2013.01); *F05D 2240/81* (2013.01); *F05D 2260/202* (2013.01)

(58) Field of Classification Search

CPC . F01D 5/18; F01D 5/187; F01D 5/147; F01D 5/20; F01D 5/225; F05D 2260/202; F05D 2240/307; F05D 2240/301; F05D 2240/24

See application file for complete search history.

(56) References Cited

U.S. PATENT DOCUMENTS

| | | | | |
|---|---|---|---|---|
| 3,876,330 A | | 4/1975 | Pearson et al. | |
| 4,127,358 A | * | 11/1978 | Parkes | F01D 5/187 416/191 |
| 4,948,338 A | | 8/1990 | Wickerson | |
| 5,511,946 A | * | 4/1996 | Lee | F01D 5/182 416/97 R |
| 6,099,253 A | | 8/2000 | Fukue et al. | |

(Continued)

FOREIGN PATENT DOCUMENTS

| | | | | |
|---|---|---|---|---|
| DE | 19904229 A1 | * | 8/2000 | F01D 5/187 |
| EP | 2607629 A1 | | 6/2013 | |

(Continued)

OTHER PUBLICATIONS

U.S. Appl. No. 14/974,155, filed Dec. 18, 2015.
U.S. Appl. No. 14/974,193, filed Dec. 18, 2015.
U.S. Appl. No. 15/615,876, filed Jun. 7, 2017.

*Primary Examiner* — Grant Moubry
(74) *Attorney, Agent, or Firm* — Dority & Manning, P.A.

(57) ABSTRACT

The present disclosure is directed to a rotor blade that includes an airfoil defining a cooling passage and a tip shroud coupled to the airfoil. The tip shroud and the airfoil define a cooling core in fluid communication with the cooling passage. The cooling core includes a first cooling channel and a second cooling channel. The first cooling channel is radially spaced apart from the second cooling channel. Coolant flows in a first direction through the first cooling channel and in a second direction through the second cooling channel. The first direction is different than the second direction.

18 Claims, 5 Drawing Sheets

(56) References Cited

U.S. PATENT DOCUMENTS 6,135,715 A * 10/2000 Correia ..... F01D 5/20 416/97 R
6,152,694 A 11/2000 Ai
6,152,695 A 11/2000 Fukue et al.
6,224,336 B1 * 5/2001 Kercher ..... F01D 5/186 415/115
6,811,378 B2 11/2004 Kraft
6,869,270 B2 * 3/2005 Bunker ..... F01D 5/187 416/189
7,029,235 B2 * 4/2006 Liang ..... F01D 5/18 416/232
7,273,347 B2 * 9/2007 Rathmann ..... F01D 5/186 415/173.6
7,568,882 B2 * 8/2009 Brittingham ..... F01D 5/187 415/1
7,600,973 B2 * 10/2009 Tibbott ..... F01D 5/187 416/189
7,686,581 B2 * 3/2010 Brittingham ..... F01D 5/187 416/97 R
7,922,451 B1 * 4/2011 Liang ..... F01D 5/187 416/97 R
7,946,816 B2 5/2011 Brittingham
8,043,058 B1 * 10/2011 Liang ..... F01D 5/187 415/173.1
8,313,287 B2 * 11/2012 Little ..... F01D 5/187 415/173.1
8,366,393 B2 * 2/2013 Tibbott ..... F01D 5/187 164/340
8,616,845 B1 * 12/2013 Liang ..... F01D 5/187 416/1
9,127,560 B2 * 9/2015 Collier ..... F01D 5/187
9,546,554 B2 * 1/2017 Crites ..... F01D 5/187
2009/0148305 A1 * 6/2009 Riahi ..... F01D 5/147 416/97 R
2012/0070309 A1 3/2012 Zambetti et al.
2012/0201695 A1 * 8/2012 Little ..... F01D 5/187 416/97 R
2014/0023497 A1 * 1/2014 Giglio ..... F01D 5/225 416/1
2015/0345301 A1 * 12/2015 Zhang ..... F01D 5/18 60/806
2015/0345303 A1 * 12/2015 Dong ..... F01D 5/187 60/806
2017/0114645 A1 4/2017 Chouhan et al.
2017/0114647 A1 4/2017 Chouhan et al.
2017/0114648 A1 4/2017 Chouhan et al.
2017/0138203 A1 5/2017 Jaiswal et al.

FOREIGN PATENT DOCUMENTS

FR 2275975 A5 1/1976
JP 5868609 B2 2/2016

* cited by examiner

TURBOMACHINE ROTOR BLADE

FIELD

The present disclosure generally relates to turbomachines. More particularly, the present disclosure relates to rotor blades for turbomachines.

BACKGROUND

A gas turbine engine generally includes a compressor section, a combustion section, and a turbine section. The compressor section progressively increases the pressure of air entering the gas turbine engine and supplies this compressed air to the combustion section. The compressed air and a fuel (e.g., natural gas) mix within the combustion section and burn within one or more combustion chambers to generate high pressure and high temperature combustion gases. The combustion gases flow from the combustion section into the turbine section where they expand to produce work. For example, expansion of the combustion gases in the turbine section may rotate a rotor shaft connected to a generator to produce electricity.

The turbine section generally includes a plurality of rotor blades. Each rotor blade includes an airfoil positioned within the flow of the combustion gases. In this respect, the rotor blades extract kinetic energy and/or thermal energy from the combustion gases flowing through the turbine section. Certain rotor blades may include a tip shroud coupled to the radially outer end of the airfoil. The tip shroud reduces the amount of combustion gases leaking past the rotor blade.

The rotor blades generally operate in extremely high temperature environments. As such, the tip shroud of each rotor blade may define a cooling core having various cooling channels through which a coolant may flow. Nevertheless, conventional cooling core configurations may limit the effectiveness of the coolant. This, in turn, may limit the operating temperature and/or the service life of the rotor blade.

BRIEF DESCRIPTION

Aspects and advantages of the technology will be set forth in part in the following description, or may be obvious from the description, or may be learned through practice of the technology.

In one aspect, the present disclosure is directed to a rotor blade. The rotor blade includes an airfoil defining a cooling passage and a tip shroud coupled to the airfoil. The tip shroud and the airfoil define a cooling core in fluid communication with the cooling passage. The cooling core includes a first cooling channel and a second cooling channel. The first cooling channel is radially spaced apart from the second cooling channel. Coolant flows in a first direction through the first cooling channel and in a second direction through the second cooling channel. The first direction is different than the second direction.

In another aspect, the present disclosure is directed to a turbomachine that includes a turbine section having one or more rotor blades. Each rotor blade includes an airfoil defining a cooling passage and a tip shroud coupled to the airfoil. The tip shroud and the airfoil define a cooling core in fluid communication with the cooling passage. The cooling core includes a first cooling channel and a second cooling channel. The first cooling channel is radially spaced apart from the second cooling channel. Coolant flows in a first direction through the first cooling channel and in a second direction through the second cooling channel. The first direction is different than the second direction.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode of practicing the various embodiments, is set forth in the specification, which makes reference to the appended figures, in which.

Figure 1:
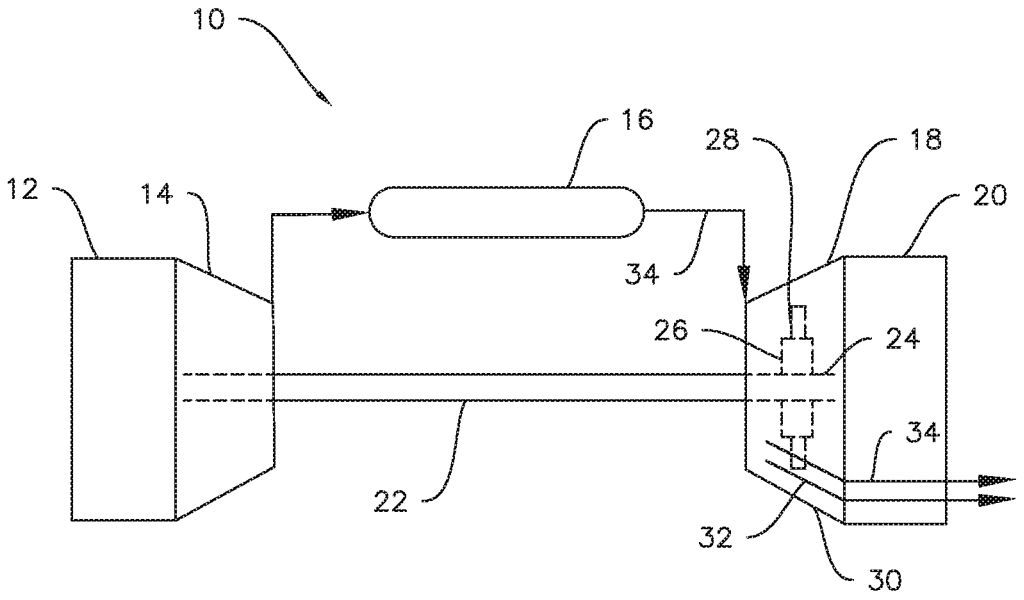
FIG. 1 is a schematic view of an exemplary gas turbine engine in accordance with embodiments of the present disclosure.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, wherein identical numerals indicate the same elements throughout the figures, FIG. 1 schematically illustrates a gas turbine engine 10. As shown, the gas turbine engine 10 may include an inlet section 12, a compressor section 14, a combustion section 16, a turbine section 18, and an exhaust section 20. The compressor section 14 and turbine section 18 may be coupled by a shaft 22. The shaft 22 may be a single shaft or a plurality of shaft segments coupled together to form the shaft 22.

The turbine section 18 may include a rotor shaft 24 having a plurality of rotor disks 26 (one of which is shown) and a plurality of rotor blades 28. Each rotor blade 28 extends radially outward from and interconnects to one of the rotor disks 26. Each rotor disk 26, in turn, may be coupled to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, the gas turbine engine 10 produces mechanical rotational energy, which may, e.g., be used to generate electricity. More specifically, air enters the inlet section 12 of the gas turbine engine 10. From the inlet section 12, the air flows into the compressor 14, where it is progressively compressed to provide compressed air to the combustion section 16. The compressed air in the combustion section 16 mixes with a fuel to form an air-fuel mixture, which combusts to produce high temperature and high pressure combustion gases 34. The combustion gases 34 then flow through the turbine 18, which extracts kinetic and/or thermal energy from the combustion gases 34. This energy extraction rotates the rotor shaft 24, thereby creating mechanical rotational energy for powering the compressor section 14 and/or generating electricity. The combustion gases 34 exit the gas turbine engine 10 through the exhaust section 20.

Figure 2:
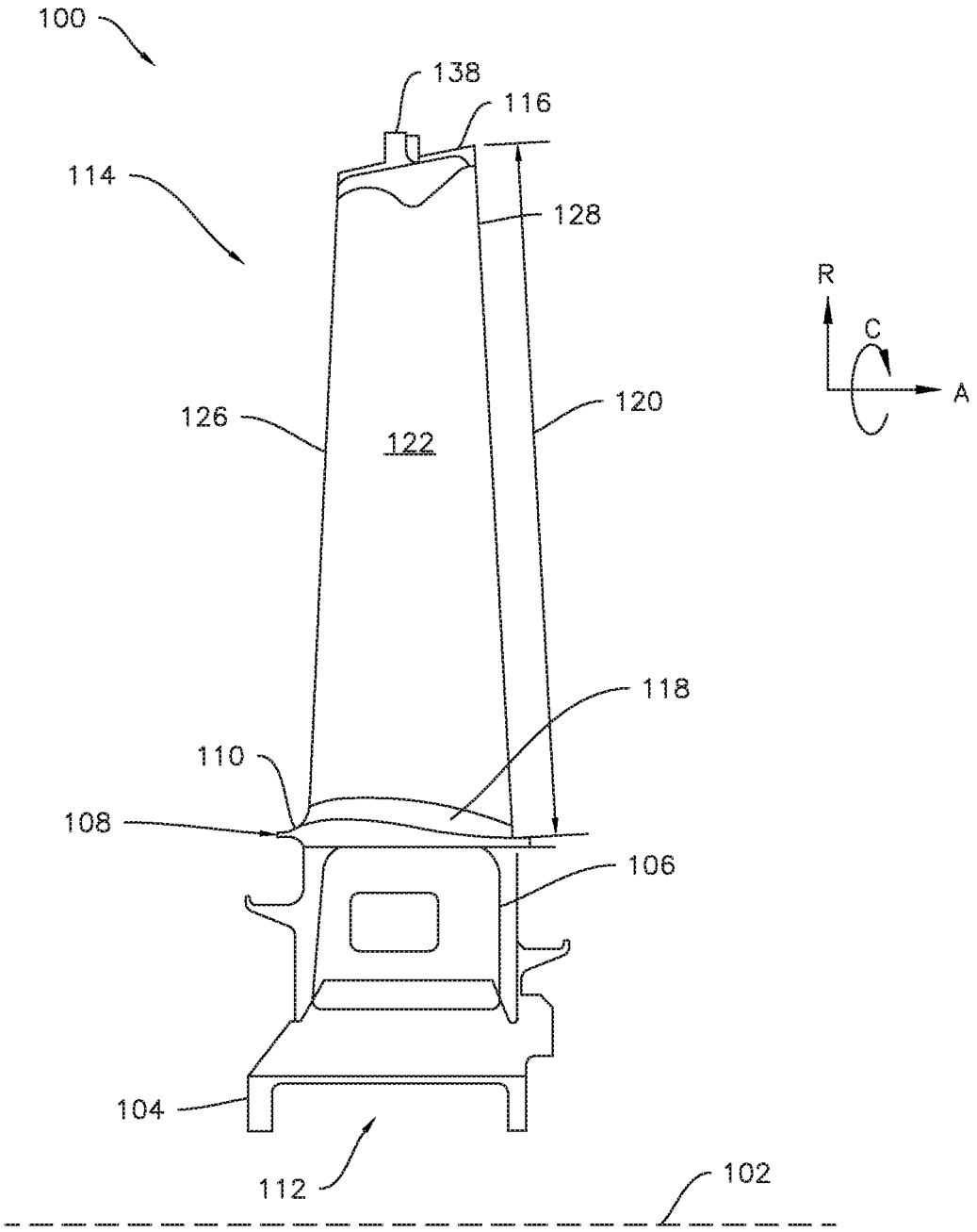
FIG. 2 is a side view of an exemplary rotor blade in accordance with embodiments of the present disclosure.

FIG. 2 is a side view of an exemplary rotor blade 100, which may be incorporated into the turbine section 18 of the gas turbine engine 10 in place of the rotor blade 28. As shown, the rotor blade 100 defines an axial direction A, a radial direction R, and a circumferential direction C. In general, the axial direction A extends parallel to an axial centerline 102 of the shaft 24 (FIG. 1), the radial direction R extends generally orthogonal to the axial centerline 102, and the circumferential direction C extends generally concentrically around the axial centerline 102. The rotor blade 100 may also be incorporated into the compressor section 14 of the gas turbine engine 10 (FIG. 1).

As illustrated in FIG. 2, the rotor blade 100 may include a dovetail 104, a shank portion 106, and a platform 108. More specifically, the dovetail 104 secures the rotor blade 100 to the rotor disk 26 (FIG. 1). The shank portion 106 couples to and extends radially outward from the dovetail 104. The platform 108 couples to and extends radially outward from the shank portion 106. The platform 108 includes a radially outer surface 110, which generally serves as a radially inward flow boundary for the combustion gases 34 flowing through the hot gas path 32 of the turbine section 18 (FIG. 1). The dovetail 104, the shank portion 106, and the platform 108 may define an intake port 112, which permits a coolant (e.g., bleed air from the compressor section 14) to enter the rotor blade 100. In the embodiment shown in FIG. 2, the dovetail 104 is an axial entry fir tree-type dovetail. Alternately, the dovetail 104 may be any suitable type of dovetail. In fact, the dovetail 104, shank portion 106, and/or platform 108 may have any suitable configurations.

Figure 3:
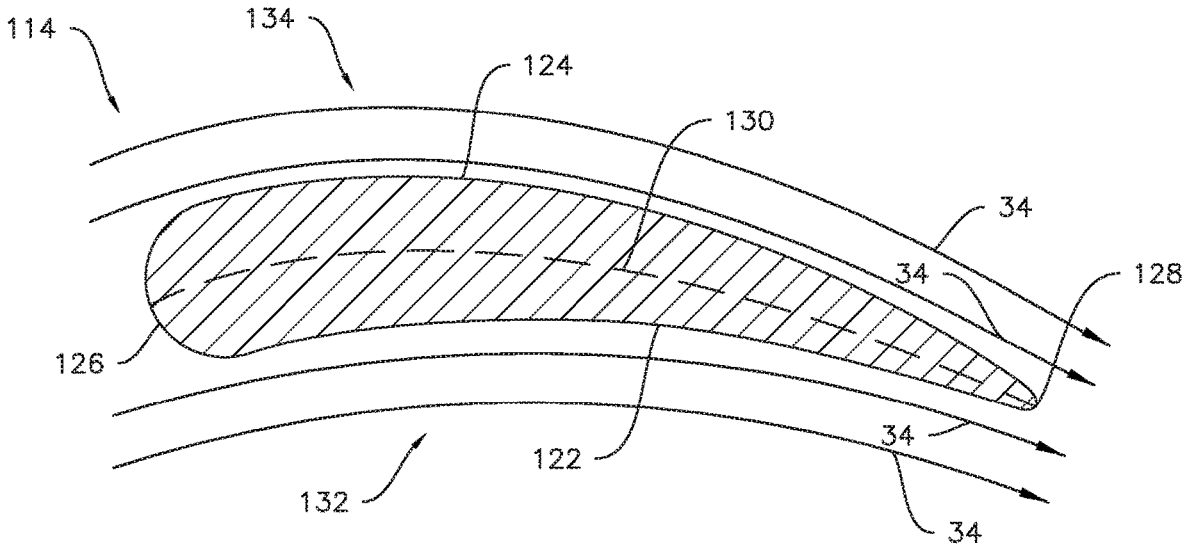
FIG. 3 is a cross-sectional view of an exemplary airfoil in accordance with embodiments of the present disclosure.

Referring now to FIGS. 2 and 3, the rotor blade 100 further includes an airfoil 114. In particular, the airfoil 114 extends radially outward from the radially outer surface 110 of the platform 108 to a tip shroud 116. The airfoil 114 couples to the platform 108 at a root 118 (i.e., the intersection between the airfoil 114 and the platform 116). In this respect, the airfoil 118 defines an airfoil span 120 extending between the root 118 and the tip shroud 116. The airfoil 114 also includes a pressure side surface 122 and an opposing suction side surface 124 (FIG. 3). The pressure side surface 122 and the suction side surface 124 are joined together or interconnected at a leading edge 126 of the airfoil 114 and a trailing edge 128 of the airfoil 114. As shown, the leading edge 126 is oriented into the flow of combustion gases 34, while the trailing edge 128 is spaced apart from and positioned downstream of the leading edge 126. The pressure side surface 122 and the suction side surface 124 are continuous about the leading edge 126 and the trailing edge 128. Furthermore, the pressure side surface 122 is generally concave, and the suction side surface 124 is generally convex.

As shown in FIG. 3, the airfoil 114 defines a camber line 130. More specifically, the camber line 130 extends from the leading edge 126 to the trailing edge 128. The camber line 130 is also positioned between and equidistant from the pressure side surface 122 and the suction side surface 124. As shown, the airfoil 114 and, more generally, the rotor blade 100 include a pressure side 132 positioned on one side of the camber line 130 and a suction side 134 positioned on the other side of the camber line 130.

Figure 4:
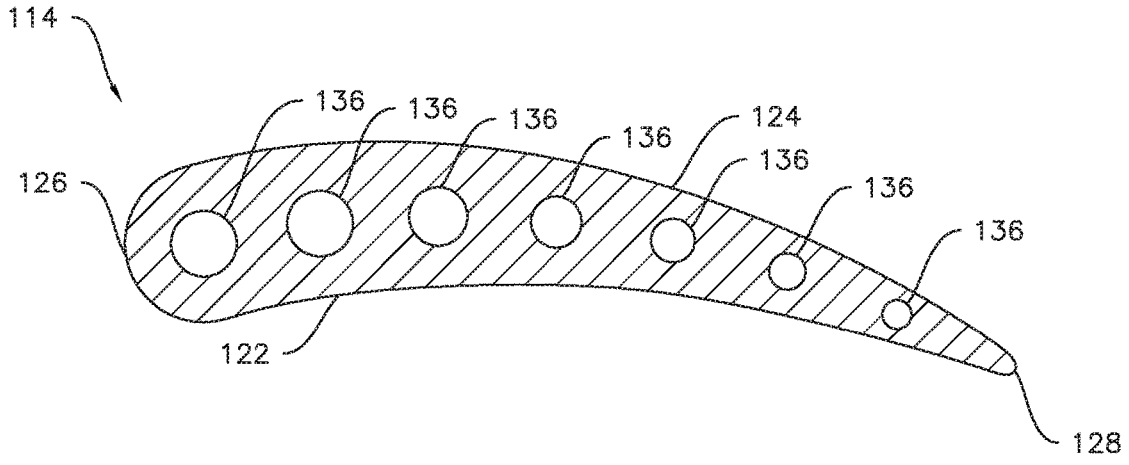
FIG. 4 is a cross-sectional view of another exemplary airfoil in accordance with embodiments of the present disclosure.

Referring now to FIG. 4, the airfoil 114 may define one or more cooling passages 136 extending therethrough. More specifically, the cooling passages 136 may extend from the tip shroud 116 radially inward to the intake port 112. In this respect, coolant may flow through the cooling passages 136 from the intake port 112 to the tip shroud 116. In the embodiment shown in FIG. 4, for example, the airfoil 114 defines seven cooling passages 136. In alternate embodiments, however, the airfoil 114 may define more or fewer cooling passages 136.

Figure 5:
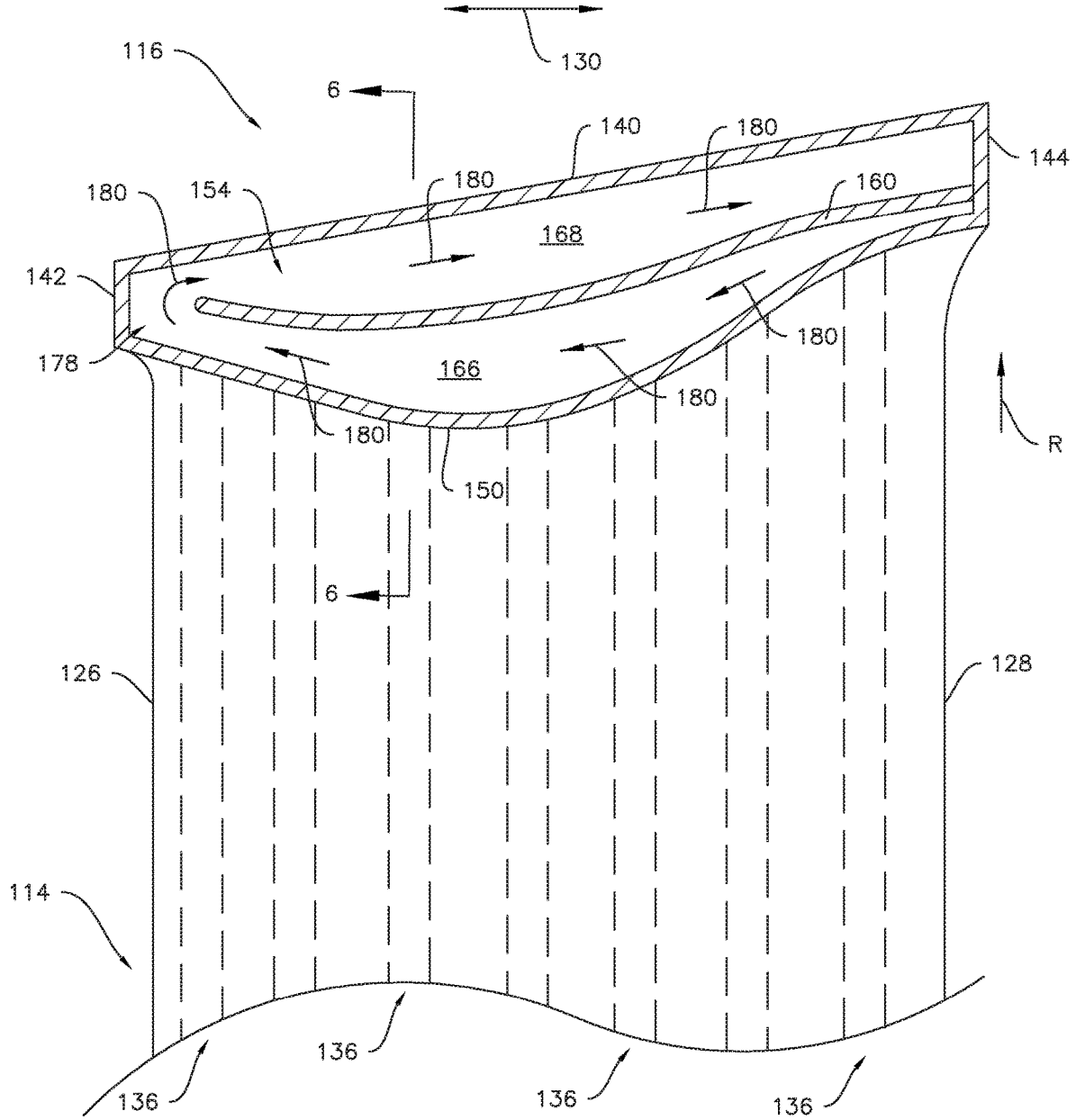
FIG. 5 is a cross-sectional view of one embodiment of a tip shroud, illustrating a cooling core having a plurality of cooling channels positioned within the cooling core in accordance with embodiments of the present disclosure.
Figure 6:
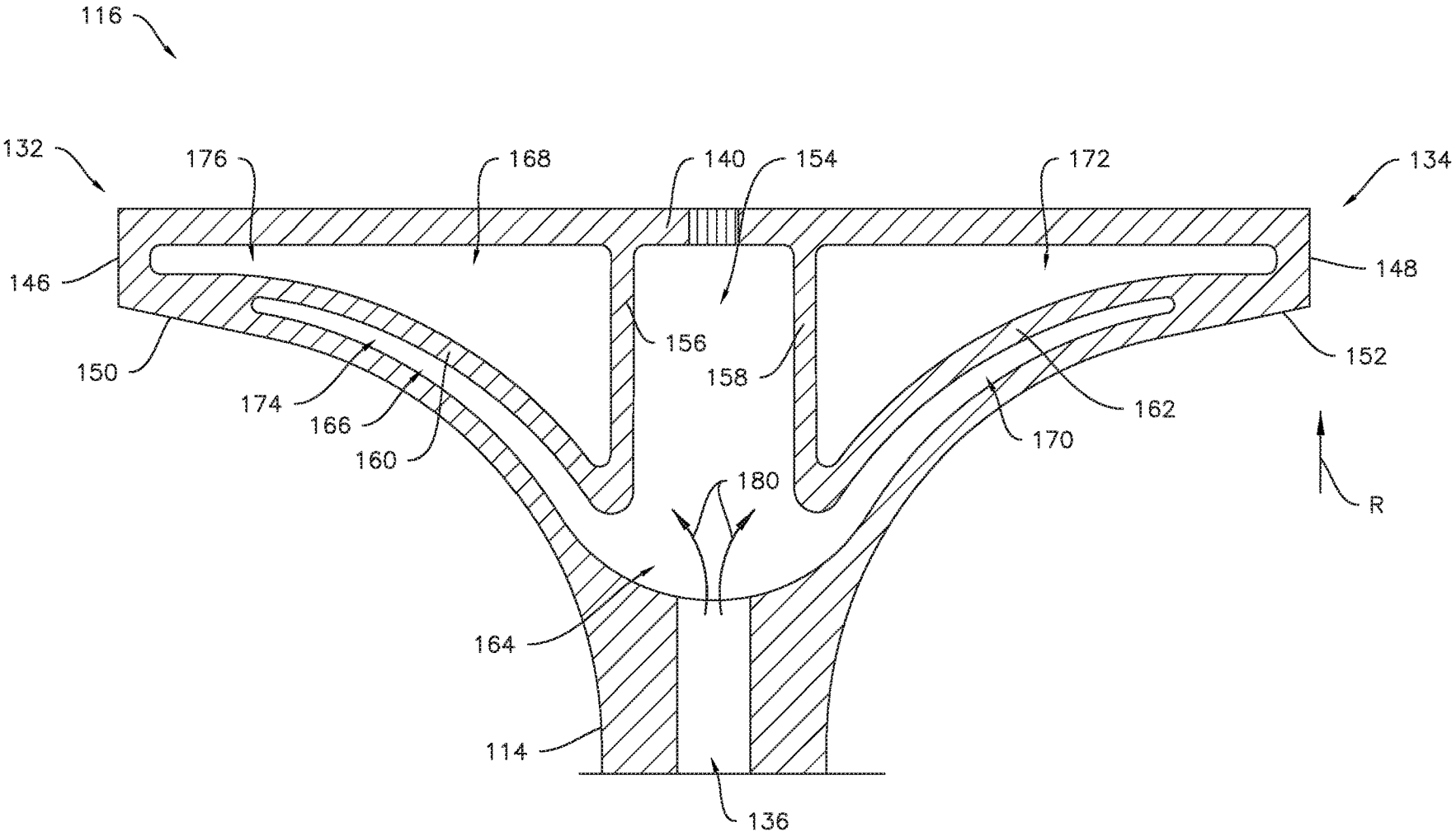
FIG. 6 is a cross-sectional view of the tip shroud taken generally about line 6-6 in FIG. 5, further illustrating the plurality of cooling channels positioned within the cooling core in accordance with embodiments of the present disclosure.

As mentioned above, the rotor blade 100 includes the tip shroud 116. As illustrated in FIGS. 2, 5, and 6, the tip shroud 116 couples to the radially outer end of the airfoil 114 and generally defines the radially outermost portion of the rotor blade 100. In this respect, the tip shroud 116 reduces the amount of the combustion gases 34 (FIG. 3) that escape past the rotor blade 100. As shown in FIG. 2, the tip shroud 116 may include a seal rail 138. Alternate embodiments, however, may include more seal rails 138 (e.g., two seal rails 138, three seal rails 138, etc.) or no seal rails 138.

Referring particularly to FIGS. 5 and 6, the tip shroud 116 includes various exterior walls. More specifically, the tip shroud 116 includes a radially outer wall 140. Although omitted from FIGS. 5 and 6 for clarity, the seal rail(s) 138 may couple to and extend radially outward from the radially outer wall 140. The tip shroud 116 may also include a forward wall 142 and an aft wall 144 spaced apart from a positioned downstream of the forward wall 142. The tip shroud 116 may further include a pressure side wall 146 positioned on the pressure side 132 of the tip shroud 116 and a suction side wall 148 positioned on the suction side 134 of the tip shroud 116. Furthermore, the tip shroud 116 may include first and second opposing fillet walls 150, 152, which couple to a radially outer end of the airfoil 114. In this respect, the fillet walls 150, 152 may transition between the airfoil 114 and the pressure side and suction side walls 146, 148. Furthermore, the fillet walls 150, 152 are radially spaced apart from the radially outer wall 140. As shown, the walls 140, 142, 144, 146, 148, 150, 152 of the tip shroud 116 and the airfoil 114 define a cooling core 154. As will be described in greater detail below, coolant flows through the cooling core 154, thereby convectively cooling the tip shroud 116. In alternate embodiments, however, the tip shroud 116 may have any suitable configuration of exterior walls.

The tip shroud 116 also includes various interior walls positioned within the cooling core 154. More specifically, the tip shroud 116 may include a first interior wall 156 positioned within the pressure side 132 of the cooling core 154 and a second interior wall 158 positioned within the suction side 134 of the cooling core 154. The first and second interior walls 156, 158 may extend radially inward from the radially outer wall 140. The tip shroud 116 may also include third and fourth interior walls 160, 162. As shown, the third and fourth interior walls 160, 162 may be positioned radially between and be radially spaced apart from the radially outer wall 140 and/or the fillet walls 150, 152. The third and fourth interior walls 160, 162 may also be coupled to one of the forward or aft walls 142, 144 and spaced apart from the other of the forward or aft walls 142, 144. In the embodiment illustrated in FIG. 5, for example, the third interior wall 160 couples to the aft wall 144 and is spaced apart from the forward wall 142. In some embodiments, the third and fourth interior walls 160, 162 may be coupled to the same one of the forward or aft walls 142, 144. Furthermore, the third interior wall 160 may extend from the pressure side wall 146 to the first interior wall 156. Similarly, the fourth interior wall 162 may extend from the suction side wall 148 to the second interior wall 158. In some embodiments, the interior walls may define pockets, channels, passages, or other voids that are fluidly isolated from the cooling core 154. In alternate embodiments, however, the tip shroud 116 may have any suitable configuration of interior walls.

Referring still to FIGS. 5 and 6, the walls of the tip shroud 116 define various cooling channels within the cooling core 154. For example, the radially outer wall 140, the first interior wall 156, the airfoil 114, and the second interior wall 158 may define a central plenum 164 of the cooling core 154. As shown, the central plenum 164 is in fluid communication with the cooling passage(s) 136 defined by the airfoil 114. The third interior wall 160, the forward wall 142, the first fillet wall 150, and the aft wall 144 may define a first cooling channel 166 of the cooling core 154. The radially outer wall 140, the forward wall 142, the third interior wall 160, the aft wall 144, the pressure side wall 146, and the first interior wall 156 may define a second cooling channel 168 of the cooling core 154. The fourth interior wall 162, the forward wall 142, the second fillet wall 152, and the aft wall 144 may define a third cooling channel 170 of the cooling core 154. The radially outer wall 140, the forward wall 142, the fourth interior wall 162, the aft wall 144, the suction side wall 148, and the second interior wall 158 may define a fourth cooling channel 172 of the cooling core 154. In alternate embodiments, the cooling core 154 may include more or fewer cooling channels so long as the cooling core 154 contains at least two cooling channels. Furthermore, the cooling channels may be defined by any suitable combination of interior and/or exterior walls.

FIGS. 5 and 6 illustrate one embodiment of an arrangement of the cooling channels within the cooling core 154. As shown, the first cooling channel 166 is radially spaced apart from and positioned radially inward from the second cooling channel 168. Similarly, the third cooling channel 170 is radially spaced apart from and positioned radially inward from the fourth cooling channel 172. In this respect, the first and third cooling channels 166, 170 may form a radially inner row of channels 174, and the second and fourth cooling channels 168, 172 may form a radially outer row of channels 176. Some embodiments may include more rows of cooling channels, such as three rows of cooling channels radially spaced apart from each other, and/or more or fewer cooling channels in each row. In further embodiments, the cooling channels 166, 168, 170, 172 may be aligned with each other along the camber line (e.g., as indicated by arrow 130 in FIG. 5). In alternate embodiments, the cooling channels may be arranged in any suitable manner within the cooling core 154 so long as at least one cooling channel is radially spaced apart from another cooling channel.

The various cooling channels of the cooling core 154 may be fluidly coupled together to permit coolant to flow throughout the tip shroud 116. More specifically, the first cooling passage 166 may be fluidly coupled to the central plenum 164. The second cooling passage 168 may, in turn, be fluidly coupled to the first cooling passage 166. For example, the first and second cooling passages 166, 168 may be fluid coupled together by a bend 178 defined between the third interior wall 160 and the forward wall 142 as shown in FIG. 5 or between the third interior wall 160 and the aft wall 144. Although, first and second cooling passages 166, 168 may be fluidly coupled in any suitable manner. The third cooling passage 170 may be fluidly coupled to the central plenum 164. The fourth cooling passage 172 may, in turn, be fluidly coupled to the third cooling passage 170. The third and fourth cooling passages 170, 172 may be fluidly coupled together in the same manner as the first and second cooling passages 166, 168. Additional cooling passages may be fluidly coupled to the second and fourth cooling passages 168, 172 in further embodiments.

During operation of the gas turbine engine 10, coolant flows through the cooling core 154 to cool the tip shroud 116. More specifically, as shown in FIGS. 5 and 6, a coolant 180 (e.g., bleed air from the compressor section 14) enters the rotor blade 100 through the intake port 112 (FIG. 2). At least a portion of the coolant 180 flows through the cooling passages 136 in the airfoil 114 and into the central plenum 164 in the tip shroud 116. From the central plenum 164, the coolant 180 flows through the cooling channels, thereby convectively cools the various walls of the tip shroud 116. The coolant 180 then exits the cooling core 154 through various outlets (not shown) and flows into the hot gas path 32 (FIG. 1).

As shown in FIGS. 5 and 6, the coolant 180 flows through radially spaced apart cooling channels in different directions, such as in opposite directions. For example, the coolant 180 may flow through the first cooling channel 166 in a first direction (e.g., a forward direction toward the leading edge 126) and then through the second cooling channel 168 in a second direction (e.g., an aft direction toward the trailing edge 128) before exiting the cooling core 154. Similarly, the coolant 180 may flow through the third cooling channel 170 in the first direction and then through the fourth cooling channel 172 in the second direction. In some embodiments, the coolant 180 may flow through all of the cooling channels in the radially inner row of cooling channels 174 in the first direction and through all of the cooling channels in the radially outer row of cooling channels 176 in the second direction. In alternate embodiments, however, the coolant 180 may flow through the cooling channels of the cooling core 154 in any suitable manner so long as the coolant 180 flows through one cooling channel in one direction and through another cooling channel in a different direction. For example, the different directions may be perpendicular or oblique to each other.

As described in greater detail above, the rotor blade 100 includes the tip shroud 116 having at least one cooling channel (e.g., the first cooling channel 166) within the cooling core 154 radially spaced from another cooling channel (e.g., the second cooling channel 168) within the cooling core 154. In this respect, and unlike conventional cooling cores, the cooling core 154 may have rows of radially stacked cooling channels. As such, the cooling core 154 may provide greater cooling to the tip shroud 116 than the cooling cores of conventional tip shrouds, thereby permitting higher operating temperatures and/or a longer service life.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A rotor blade for a turbomachine, the rotor blade comprising:

an airfoil defining a cooling passage; and a tip shroud coupled to the airfoil, the tip shroud including a radially outer wall, the tip shroud and the airfoil defining a cooling core in fluid communication with the cooling passage, the cooling core including a first cooling channel and a second cooling channel, the first cooling channel being radially spaced apart from the second cooling channel, the tip shroud further including a first interior wall positioned within the cooling core and extending radially inward from the radially outer wall and a second interior wall positioned within the cooling core and coupled to the first interior wall such that the radially outer wall, the first interior wall, and the second interior wall at least partially define the second cooling channel, wherein coolant flows in a first direction through the first cooling channel before flowing in a second direction through the second cooling channel, the first direction being different than the second direction.

2. The rotor blade of claim 1, wherein the first direction is opposite of the second direction.

3. The rotor blade of claim 1, wherein the second interior wall at least partially defines the first cooling channel.

4. The rotor blade of claim 2, wherein the tip shroud further comprises a fillet wall that partially defines the first cooling channel.

5. The rotor blade of claim 1, wherein the second interior wall is radially spaced apart from the radially outer wall.

6. The rotor blade of claim 1, wherein the first cooling channel is at least partially aligned along a camber line of the airfoil with the second cooling channel.

7. The rotor blade of claim 1, wherein the cooling core comprises a third cooling channel and a fourth cooling channel, the third cooling channel being radially spaced apart from the fourth cooling channel, and wherein the coolant flows in the first direction through the third cooling channel and in the second direction through the fourth cooling channel.

8. The rotor blade of claim 7, wherein the first and third cooling channels define a radially inner row of cooling channels and the second and fourth cooling channels define a radially outer row of cooling channels.

9. The rotor blade of claim 1, wherein the first cooling channel is in fluid communication with the second cooling channel.

10. A turbomachine, comprising:

a turbine section including one or more rotor blades, each rotor blade including:

an airfoil defining a cooling passage; and a tip shroud coupled to the airfoil, the tip shroud including a radially outer wall, the tip shroud and the airfoil defining a cooling core in fluid communication with the cooling passage, the cooling core including a first cooling channel and a second cooling channel, the first cooling channel being radially spaced apart from the second cooling channel, the tip shroud further including a first interior wall positioned within the cooling core and extending radially inward from the radially outer wall and a second interior wall positioned within the cooling core and coupled to the first interior wall such that the radially outer wall, the first interior wall, and the second interior wall at least partially define the second cooling channel, wherein coolant flows in a first direction through the first cooling channel before flowing in a second direction through the second cooling channel, the first direction being different than the second direction.

11. The turbomachine of claim 10, wherein the first direction is opposite of the second direction.

12. The turbomachine of claim 10, wherein the second interior wall at least partially defines the first cooling channel.

13. The turbomachine of claim 11, wherein the tip shroud further comprises a fillet wall that partially defines the first cooling channel.

14. The turbomachine of claim 10, wherein the second interior wall is radially spaced apart from the radially outer wall.

15. The turbomachine of claim 10, wherein the first cooling channel is at least partially aligned along a camber line of the airfoil with the second cooling channel.

16. The turbomachine of claim 10, wherein the cooling core comprises a third cooling channel and a fourth cooling channel, the third cooling channel being radially spaced apart from the fourth cooling channel, and wherein the coolant flows in the first direction through the third cooling channel and in the second direction through the fourth cooling channel.

17. The turbomachine of claim 16, wherein the first and third cooling channels define a radially inner row of cooling channels and the second and fourth cooling channels define a radially outer row of cooling channels.

18. The turbomachine of claim 10, wherein the first cooling channel is in fluid communication with the second cooling channel.

* * * * *